US012345123B2

(12) United States Patent
Tveranger et al.

(10) Patent No.: US 12,345,123 B2
(45) Date of Patent: Jul. 1, 2025

(54) SUPPORT STRUCTURE APPARATUS AND METHODS FOR FASTENING A LINER RING THERETO

(71) Applicant: SBS Technology AS, Indre Arna (NO)

(72) Inventors: Jan Tore Tveranger, Indre Arna (NO); Anthony Kent, Houston, TX (US)

(73) Assignee: SBS Technology AS, Indre Arna (NO)

( * ) Notice: Subject to any disclaimer, the term of this patent is extended or adjusted under 35 U.S.C. 154(b) by 0 days.

(21) Appl. No.: 18/361,115

(22) Filed: Jul. 28, 2023

(65) Prior Publication Data

US 2024/0035361 A1 Feb. 1, 2024

Related U.S. Application Data

(60) Provisional application No. 63/393,488, filed on Jul. 29, 2022.

(51) Int. Cl.
*E21B 33/13* (2006.01)

(52) U.S. Cl.
CPC ..... *E21B 33/13* (2013.01)

(58) Field of Classification Search
CPC ..... E21B 33/1208; E21B 34/063
See application file for complete search history.

(56) References Cited

U.S. PATENT DOCUMENTS

| | | | | |
|---|---|---|---|---|
| 3,661,206 | A | 5/1972 | Putch et al. | |
| 5,318,131 | A | 6/1994 | Baker | |
| 10,544,654 | B2 * | 1/2020 | Bjørgum | E21B 33/134 |
| 12,037,872 | B2 * | 7/2024 | Hiorth | E21B 33/1208 |
| 2006/0016604 | A1 | 1/2006 | Ford | |
| 2019/0017345 | A1 * | 1/2019 | Brandsdal | E21B 33/1208 |
| 2019/0032448 | A1 * | 1/2019 | Bjørgum | E21B 34/063 |
| 2022/0251922 | A1 * | 8/2022 | Hiorth | E21B 34/103 |
| 2023/0131218 | A1 * | 4/2023 | Werries | F16K 17/16 166/374 |
| 2023/0400059 | A1 * | 12/2023 | Eriksen | F16J 15/104 |
| 2024/0035361 | A1 * | 2/2024 | Tveranger | E21B 43/10 |

FOREIGN PATENT DOCUMENTS

| | | | |
|---|---|---|---|
| NO | 20160249 | A1 | 6/2016 |
| WO | 2022098533 | A1 | 5/2022 |

OTHER PUBLICATIONS

International Search Report in PCT/IB2023/000443, mailed Mar. 1, 2024, 5 pages.

* cited by examiner

*Primary Examiner* — Jennifer H Gay
(74) *Attorney, Agent, or Firm* — ArentFox Schiff LLP

(57) ABSTRACT

A structural support apparatus for positioning in a downhole tubular string includes a support structure base and a liner ring having a first contact load surface in contact with a contact load surface of the base. A fastening mechanism is positioned between the base and the liner ring, where the fastening mechanism is configured to prevent movement of the liner ring relative to the base. A method for fastening a liner ring to a support structure apparatus in a downhole tubular string includes positioning a first contact load surface of the liner ring along a contact load surface of a support structure base. A second contact load surface of the liner ring is positioned along a frangible disk. A fastening mechanism is positioned between the base and the liner ring, where the fastening mechanism is configured to prevent movement of the liner ring relative to the base.

17 Claims, 8 Drawing Sheets

SUPPORT STRUCTURE APPARATUS AND METHODS FOR FASTENING A LINER RING THERETO

FIELD OF THE INVENTION

The present disclosure generally relates to support mechanisms in downhole tubular strings, and more particularly, to methods and apparatuses for fastening liner rings to support structures in downhole tubular strings.

BACKGROUND OF THE INVENTION

Frangible disks are used in downhole tubular strings for purposes of providing temporary pressure isolation between parts of a tubular string above and below the disk. The frangible disks need to maintain pressure integrity when there is pressure differential across the disk. Due to manufacturing limitations, the frangible disks are typically not threaded to another fixed component, and as such, must be supported in another way by a surface that is fixed, otherwise called the support mechanism. Due to the potentially high differential pressure across the frangible disk and other loads (such as tension and compression forces) in the system, often the support mechanism is made of a material with high yield strength and hardness, exceeding that of the frangible disk. The frangible disks can be susceptible to breaking if exposed to point loading by a harder material, such as steel; as such, a liner ring with different material properties and contact load surfaces on opposite sides of itself is employed between the contact load surfaces of the frangible disk and support mechanism. If there are irregularities in the contact load surface of the frangible disk or the support mechanism, the liner ring will yield before the stress concentration increases beyond the limitations of the frangible disk, thereby distributing contact stresses more evenly around the contact load surfaces, eliminating or reducing point loads, and preventing the frangible disk from breaking.

The frangible disks used in downhole tubular strings are inevitably meant to be broken after they have served their functional purpose. When the frangible disk is broken, the liner ring is no longer in contact with two opposing contact load surfaces and is therefore free to move with more degrees of freedom compared to when the frangible disk was intact. Furthermore, sometimes the action of breaking the frangible disk itself also damages the liner ring, thereby adding another degree of freedom that the liner ring can move. As a result of the additional degrees of freedom and/or damage that occurs during or after the breaking of the frangible disk, it is common that the liner ring is dislodged from its initial location and/or is deformed by forces applied to it by the downhole environment; this introduces a possibility that the liner ring then partially blocks the internal bore of the tubular string, which in turn presents a risk for subsequent operations, such as blocked passage of mechanical intervention equipment or undesirable production of pieces of the liner ring.

DESCRIPTION OF THE RELATED ART

Previous iterations of support mechanisms have relied on liner rings, but have not provided a fastening mechanism. This is due, in part to pressures and temperatures downhole being low enough that the liner ring material could be sufficiently soft to where the liner ring was easily displaced or disintegrated during subsequent operations, even if they did block the internal bore of the tubular string. Today, however, the stresses seen by frangible disks in downhole tools are increasing due to more challenging environments and demand more durable liner rings. The more durable liner rings present more risk because they are more difficult to displace or disintegrate. Because of the increased durability, liner rings have become more prone to at least partially blocking the internal bore of the tubular string.

BRIEF SUMMARY OF THE INVENTION

According to an embodiment of the present disclosure, a support structure apparatus for positioning in a downhole tubular string having a tubular axis is disclosed. The apparatus includes a support structure base and a liner ring having a first contact load surface. The first contact load surface is in contact with a substantially similar contact load surface of the support structure base. A fastening mechanism is positioned between the support structure base and the liner ring, where the fastening mechanism is configured to prevent movement of the liner ring relative to the support structure base. The apparatus is advantageous in that the liner ring is prevented from separating from the support structure base, leading to the reduction/elimination of associated operational risks.

In one embodiment, which can be combined with the previous embodiment, the liner ring includes a second contact load surface in contact with a frangible disk.

In another embodiment, which can be combined with the previous embodiments, the liner ring is separated from the frangible disk in a second position where the frangible disk is broken.

In another embodiment, which can be combined with the previous embodiments, the liner ring includes a first portion and a second portion defining the first contact load surface, where the second portion of the liner ring is parallel to the tubular axis.

In another embodiment, which can be combined with the previous embodiments, the fastening mechanism is at least one of: an adhesive, snap rings, a weld, threading, screws, rivets, or an interference fit between the liner ring and at least the support structure base.

In another embodiment, which can be combined with the previous embodiments, the fastening mechanism is a mating geometry between the liner ring, the support structure base, and at least a third part.

In another embodiment, which can be combined with the previous embodiments, the at least third part is at least one of: rigidly fixed relative to the support structure apparatus or pliantly fixed relative to the support structure apparatus.

In another embodiment, which can be combined with the previous embodiments, the liner ring includes a circumference that is at least one of: fully segmented or partially segmented.

In another embodiment, which can be combined with the previous embodiments, the support structure base comprises at least one structural feature for mating with the liner ring.

In another embodiment, which can be combined with the previous embodiments, each of the at least one structural feature is a groove, a thread, a hole, or a slot.

According to an embodiment of the present disclosure, a method for fastening a liner ring to a support structure apparatus in a downhole tubular string having a tubular axis is disclosed. The method includes positioning a first contact load surface of the liner ring along a substantially similar contact load surface of a support structure base. Once the first contact load surface is positioned, a second contact load surface of the liner ring is positioned along a frangible disk in a first position. The liner ring is then fastened to the support structure base via a fastening mechanism, where the fastening mechanism is configured to prevent movement of the liner ring relative to the support structure base. The method is advantageous in that the liner ring is prevented from separating from the support structure base, leading to the reduction/elimination of associated operational risks.

In one embodiment, which can be combined with the previous embodiment, the method further includes forming at least one of the first contact load surface and the second contact load surface with a defined contact geometry, where the defined contact geometry is at least one of: positioned along a plane perpendicular to the tubular axis, is frustoconical and shares an axis with a tubular of the tubular string, is frustoconically concave, or is frustoconically convex.

In another embodiment, which can be combined with the previous embodiments, the method further includes forming a first portion of the first contact load surface and a second portion of the first contact load surface, where the second portion of the first contact load surface is parallel to the tubular axis.

In another embodiment, which can be combined with the previous embodiments, the liner ring is separated from the frangible disk in a second position where the frangible disk is broken.

In another embodiment, which can be combined with the previous embodiments, the first contact load surface and the substantially similar contact load surface of the support structure base remain in contact when the frangible disk is in the second position.

In another embodiment, which can be combined with the previous embodiments, the fastening mechanism prevents movement of the liner ring relative to the support structure apparatus when the frangible disk is in either of the first position or the second position.

In another embodiment, which can be combined with the previous embodiments, the positioning of the fastening mechanism further includes at least one of: welding the liner ring to the support structure apparatus, threading the liner ring to the support structure apparatus, screwing the liner ring to the support structure apparatus, riveting the liner ring to the support structure apparatus, or interference fitting the liner ring to at least the support structure apparatus.

In another embodiment, which can be combined with the previous embodiments, the method further includes providing a mating geometry between the liner ring, the support structure base, and at least a third part.

In another embodiment, which can be combined with the previous embodiments, the at least third part is at least one of: rigidly fixed relative to the support structure apparatus or pliantly fixed relative to the support structure apparatus.

In another embodiment, which can be combined with the previous embodiments, the method further includes forming a liner ring circumference that is at least one of: fully segmented or partially segmented.

BRIEF DESCRIPTION OF THE DRAWINGS

The disclosed subject matter, objectives, and advantages thereof, will best be understood by reference to the following detailed description of illustrative embodiments when read in conjunction with the accompanying drawings, wherein.

DETAILED DESCRIPTION

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
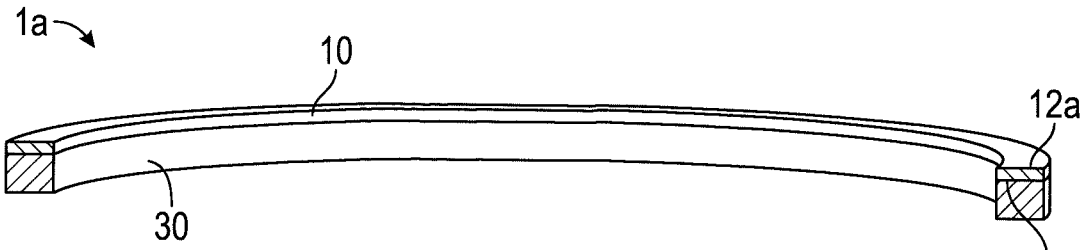
FIG. 1 displays a cross-sectional view of a support structure apparatus, according to an illustrative embodiment.

FIG. 1 displays a cross-sectional view of a support structure apparatus 1*a*, according to an illustrative embodiment. The support structure apparatus 1*a* is configured to be positioned in a downhole tubular string having a tubular axis. The support structure apparatus 1*a* includes a support structure base 30 and a liner ring 10 having a first contact load surface 12*b*. As shown, liner ring 10 is a circular ring with different material properties than a frangible disk 40 (and typically also the support structure base 30) and includes contact load surfaces 12*a*, 12*b* positioned on opposite sides of itself. First contact load surface 12*b* is in contact with a substantially similar contact load surface of the support structure base 30 (surface opposing first contact load surface 12*b*). A second contact load surface 12*a* is configured to contact a frangible disk 40 in a first position (positioned on top of second contact load surface 12*a*) when utilized in a downhole tubular string. It is noted that the first and second contact load surfaces 12*b*, 12*a* of liner ring 10 of FIG. 1 are formed with a defined contact geometry positioned along a plane perpendicular to the tubular axis. Substantially similar contact load surfaces are formed on support structure base 30 and the frangible disk 40 to match first and second contact load surfaces 12*b*, 12*a*.

Figure 2:
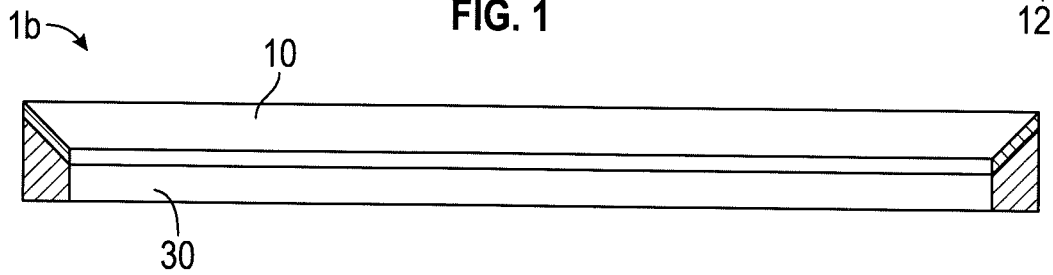
FIG. 2 displays a cross-sectional view of a support structure apparatus including an alternative liner ring, according to an illustrative embodiment.
Figure 3:
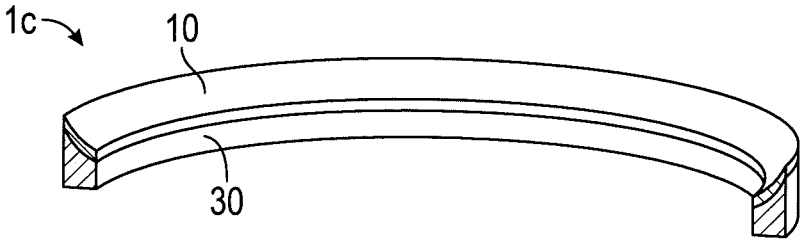
FIG. 3 displays a cross-sectional view of a support structure apparatus including an alternative liner ring, according to an illustrative embodiment.

Reference is now made to FIGS. 2 and 3, which display cross-sectional views of support structure apparatus 1*b*,1*c* including alternative liner rings 10, according to an illustrative embodiment. As shown in FIG. 2, a liner ring 10 is displayed having a frustoconical shape and first and second contact load surfaces 12*b*,12*a* formed with a defined contact geometry being frustoconical and shares an axis with a tubular of the tubular string. As shown in FIG. 3, a liner ring 10 is displayed having a frustoconically concave shape and first and second contact load surfaces 12*b*,12*a* formed with a defined contact geometry being frustoconically concave. In an embodiment, a liner ring 10 includes a frustoconically convex shape (not depicted) and first and second contact load surfaces 12*b*, 12*a* formed with a defined contact geometry being frustoconically convex. Substantially similar contact load surfaces are formed on support structure base 30 and the frangible disk 40 to match first and second contact load surfaces 12*b*,12*a* of the liner rings 10 presented in FIGS. 2 and 3 (as well as the frustoconically convex liner ring 10).

Figure 4A:
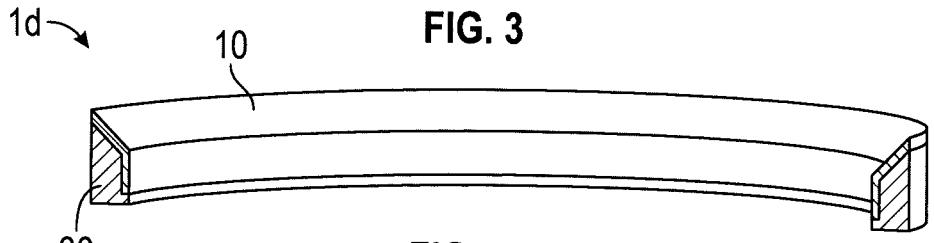
FIG. 4A displays a cross-sectional view of a support structure apparatus including an alternative liner ring, according to an illustrative embodiment.
Figure 4B:
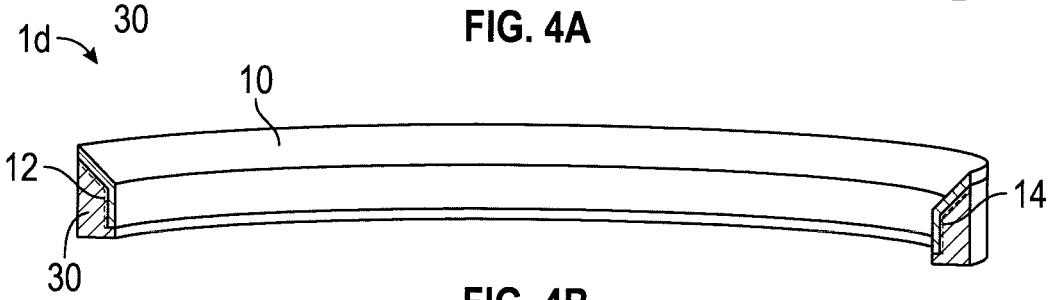
FIG. 4B displays a cross-sectional view of a support structure apparatus including an alternative liner ring affixed to a support structure base, according to an illustrative embodiment.
Figure 5:
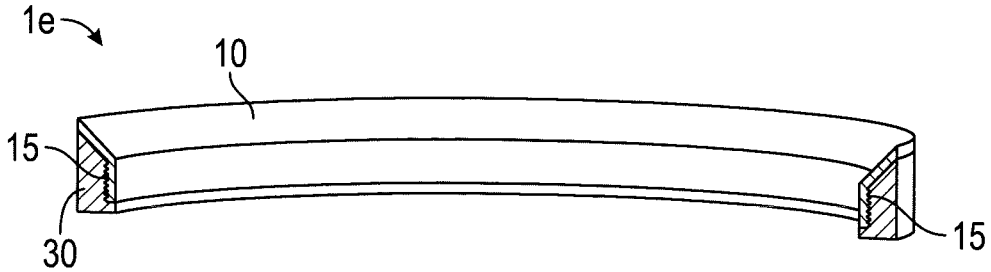
FIG. 5 displays a cross-sectional view of a support structure apparatus including an alternative liner ring threaded to a support structure base, according to an illustrative embodiment.

Reference is now made to FIGS. 4A and 4B, which display cross-sectional views of a support structure apparatus 1*d* including alternative liner rings 10, according to illustrative embodiments. As shown in FIG. 4A, a liner ring 10 is displayed having a first (diagonal) portion and a second portion defining the first contact load surface 12*b*, wherein the second portion of the liner ring 10 is parallel to the tubular axis. FIG. 4B displays a similar liner ring 10, where a fastening mechanism 14 is positioned between first contact load surface 12*b* and substantially similar contact load surface of support structure base 30. Fastening mechanism 14 is configured to prevent movement of liner ring 10 relative to support structure base 30. In embodiments, fastening mechanism may be applied between any configuration of first contact load surface 12*b* and a matching substantially similar contact load surface of support structure base 30. As presented in FIG. 5, a cross-sectional view of a support structure apparatus 1*e* includes an alternative liner ring 10 threaded to a support structure base 30. As shown, fastening mechanism 14 affixing liner ring 10 to support structure base 30 are mating threads.

Figure 6:
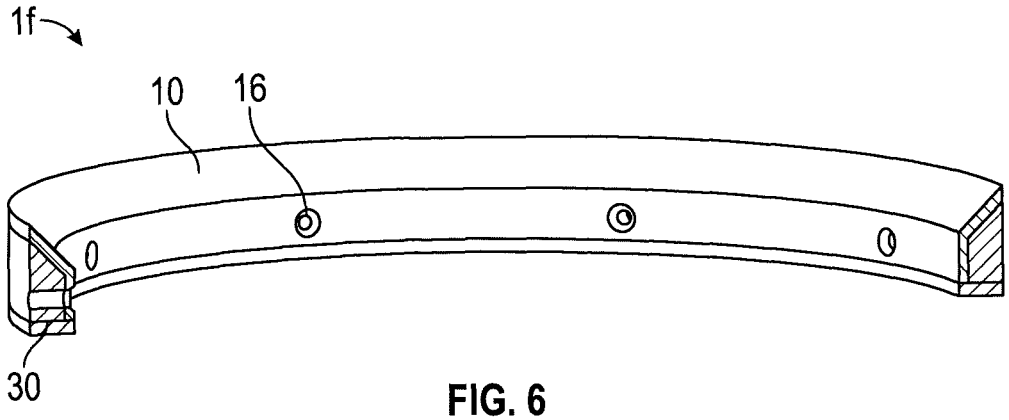
FIG. 6 displays a cross-sectional view of a support structure apparatus including an alternative liner ring and a support structure base having through-holes, according to an illustrative embodiment.
Figure 7:
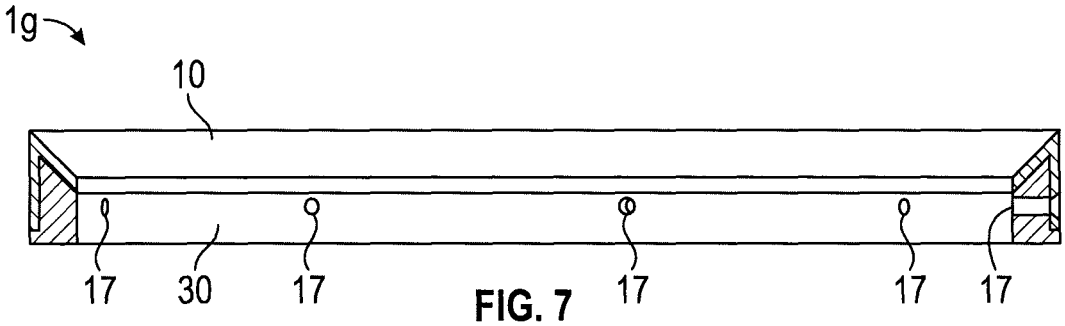
FIG. 7 displays a cross-sectional view of a support structure apparatus including an alternative liner ring and a support structure base having through-holes, according to an illustrative embodiment.
Figure 8:
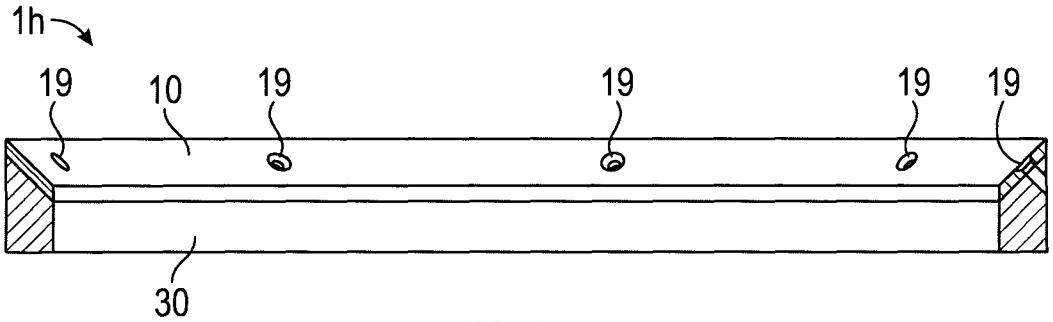
FIG. 8 displays a cross-sectional view of a support structure apparatus including a liner ring and a support structure base having through-holes, according to an illustrative embodiment.

Reference is now made to FIGS. 6, 7, and 8, which display cross-sectional views of support structure apparatuses 1*f*, 1*g*, 1*h* including liner rings 10/alternative liner rings 10 and support structure bases 30 having through-holes, according to illustrative embodiments. As shown in FIG. 6, through-holes 16 (an alternative fastening mechanism 14) are spaced along a second portion of liner ring 10 and extend outwardly through support structure base 30. The through-holes 16 are configured to receive a mating element to secure liner ring 10 to support structure base 30. In FIG. 7, the second portion of the liner ring 10 is positioned on an exterior surface of the support structure base 30. Through-holes 16 in this embodiment are positioned inward and penetrate through the second portion of the liner ring 10 and support structure base 30. In FIG. 8, liner ring 10 is positioned on a support structure base 30 in a frustoconical configuration. Through-holes 16 in this embodiment are positioned diagonally outward and penetrate through the liner ring 10 and support structure base. In embodiments, the mating elements receivable by through-holes 16 include at least one of: screws or rivets.

It is noted that liner ring 30 is placed on support structure base 30 on first contact load surface 12*b* using a fastening mechanism 14 such that when the frangible disk 40 is broken, liner ring 10 is separated from the frangible disk 40 in a second (broken) position and liner ring 10 is prevented from separating from support structure base 30 via fastening mechanism 14 (the first contact load surface 12*b* of liner ring 10 and the substantially similar contact load surface of support structure base 30 remain in contact when the frangible disk 40 is in the second position).

In an embodiment, the fastening mechanism 14 prevents movement of the liner ring 10 relative to the support structure apparatus 30 when the frangible disk 40 is in either of the first position or the second position.

Figure 9:
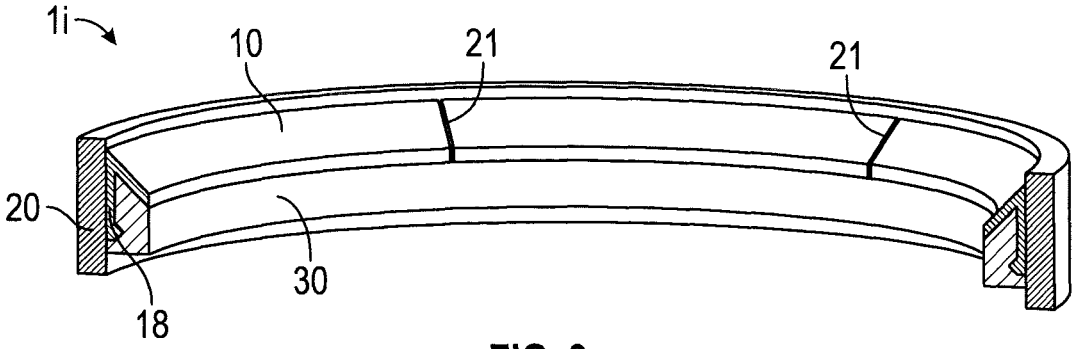
FIG. 9 displays a cross-sectional view of a support structure apparatus including a third part, according to an illustrative embodiment.

Reference is now made to FIG. 9, which displays a cross-sectional view of a support structure apparatus 1*i* including a third part 20, according to an illustrative embodiment. As shown, third part 20 is presented as a wall surrounding and in contact with surfaces of liner ring 10 and support structure base 30. Once support structure base 30 is affixed to at least a third part 20, a fastening mechanism 14 is defined in the form of a mating geometry 18 between liner ring 10, support structure base 30, and third part 20; alternatively, this can be referred to as an interference fit between liner ring 10, support structure base 30, and third part 20. In this configuration, the liner ring 10 includes a second portion having a protrusion that is slid between support structure base 30 and third part 20 until a mating fit is formed between the protrusion and an indented slot defined by the support structure base 30 and the third part 20. In an embodiment, the at least third part 20 is at least one of: rigidly fixed relative to the support structure apparatus 1*i* or pliantly fixed relative to the support structure apparatus 1*i*. As further shown in this embodiment, liner ring 10 is segmented into three separate parts.

Figure 10:
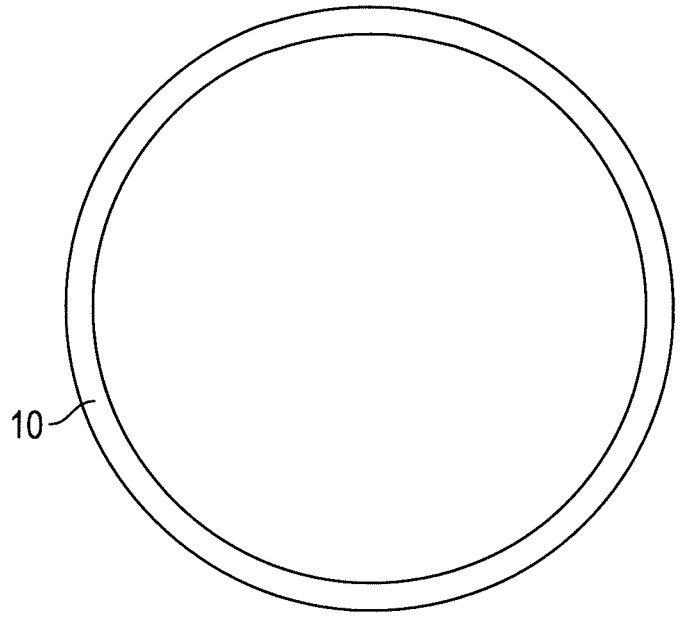
FIG. 10 displays a top view of a liner ring, according to an illustrative embodiment.
Figure 11:
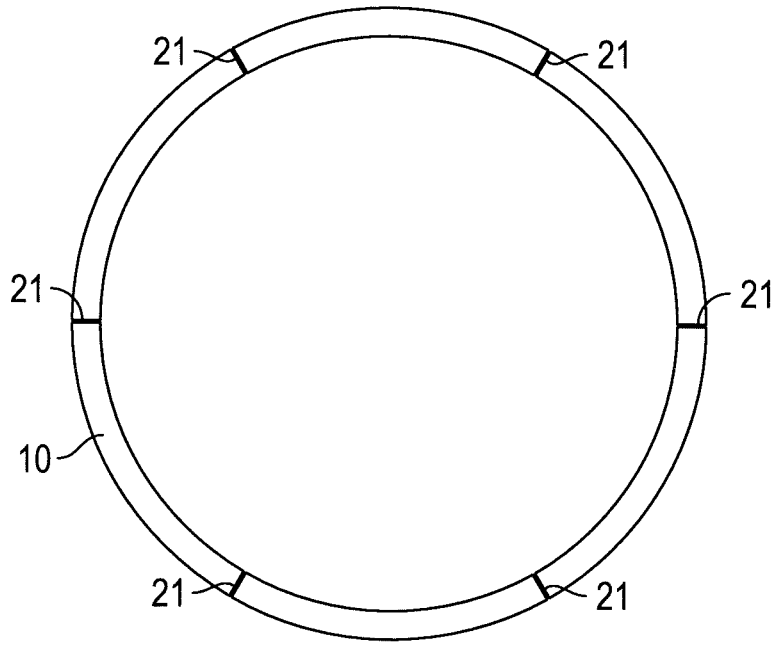
FIG. 11 displays show top views of embodiments of a liner ring according to an illustrative embodiment.
Figure 12:
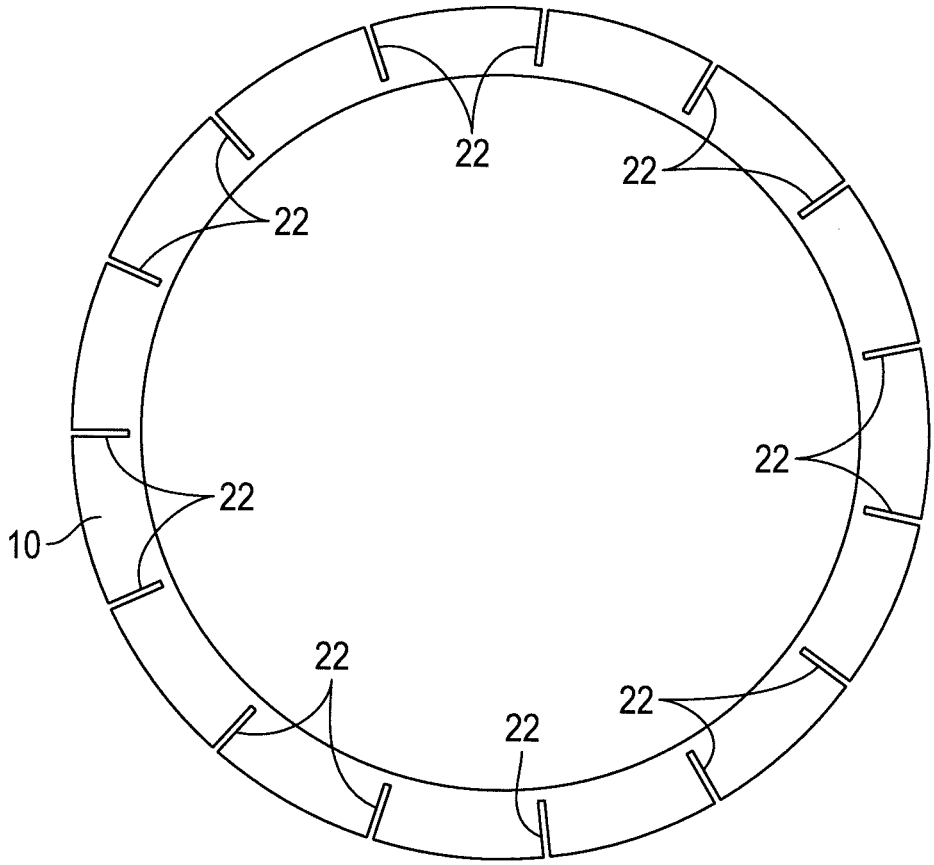
FIG. 12 displays show top views of embodiments of a liner ring according to an illustrative embodiment.

Reference is now made to FIGS. 10, 11, and 12, which display top views of a liner ring 10, according to illustrative embodiments. As shown in FIG. 10, a liner ring 10 includes an uninterrupted circumference. As shown in FIG. 11, a liner ring 10 includes a circumference that is segmented. As shown in FIG. 12, a liner ring 10 includes a circumference that is partially segmented. The segmentation/partial segmentation of liner ring 10 may provide an increased potential for the liner ring to not become trapped in the tubular string once the frangible disk 40 is ruptured.

Figure 13:
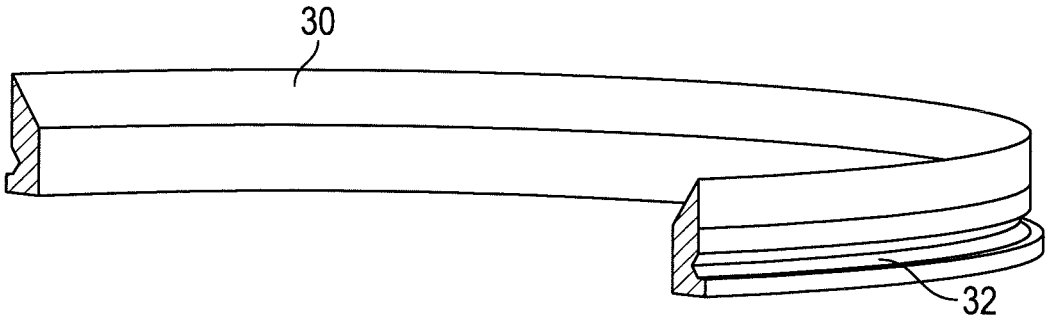
FIG. 13 displays a cross-sectional view of a support structure base including a structural feature, according to an illustrative embodiment.
Figure 14:
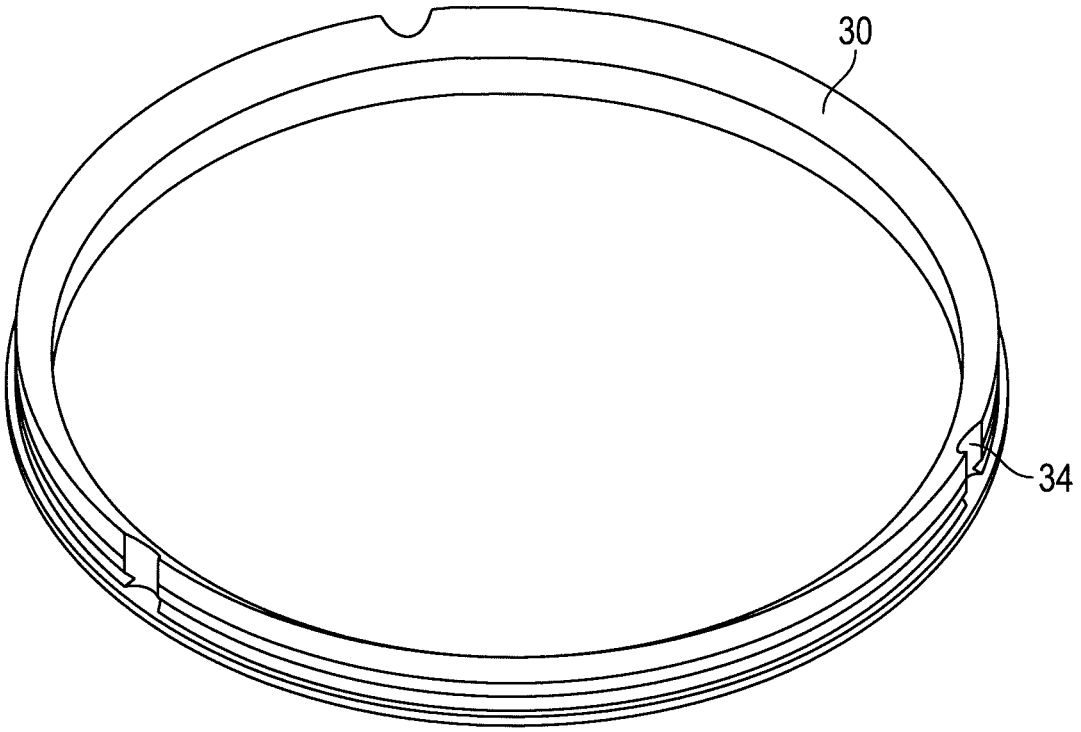
FIG. 14 displays a perspective view of a support structure base including a structural feature, according to an illustrative embodiment.
Figure 15:
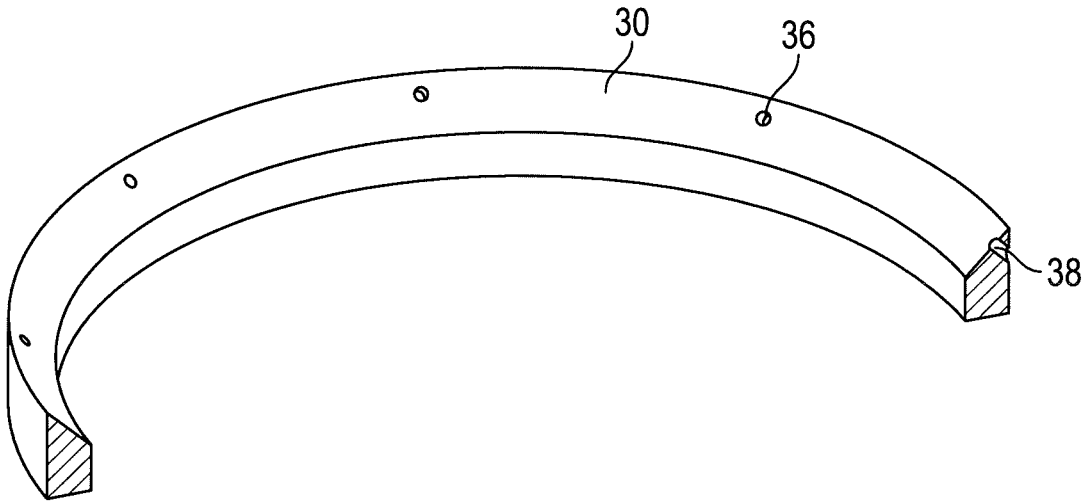
FIG. 15 displays a partial perspective and cross-sectional view of a support structure base including a structural feature, according to an illustrative embodiment.

Reference is now made to FIGS. 13, 14, and 15, which display cross-sectional and perspective views of a support structure base 30 including structural features 32,34,36,38 according to illustrative embodiments. Support structure base 10 includes at least one structural feature 32,34,36,38 for mating with liner ring 10. As shown in FIG. 13, a support structure base 30 includes a circumferential groove 32 that can be utilized in an interference fit (similar to interference fit found in FIG. 9) between at least support structure base 30 and a liner ring 10. As shown in FIG. 14, a support structure base 30 includes axial grooves 34 that can be utilized in an alternative interference fit between support structure base 30 and a liner ring 10. In order to match the axial grooves 34, an interior surface of a second portion of the liner ring 10 (parallel to the tubular axis) includes molded protrusions that match the shape of the axial grooves 34. As shown in FIG. 15, a support structure base 30 includes holes 36 (presented similarly in FIGS. 6-8) and slots 38 that can be utilized to mate support structure base 30 and a liner ring 10 with mating elements (such as, for example, screws and rivets). In a further embodiment, the at least one structural feature includes a thread.

Figure 17:
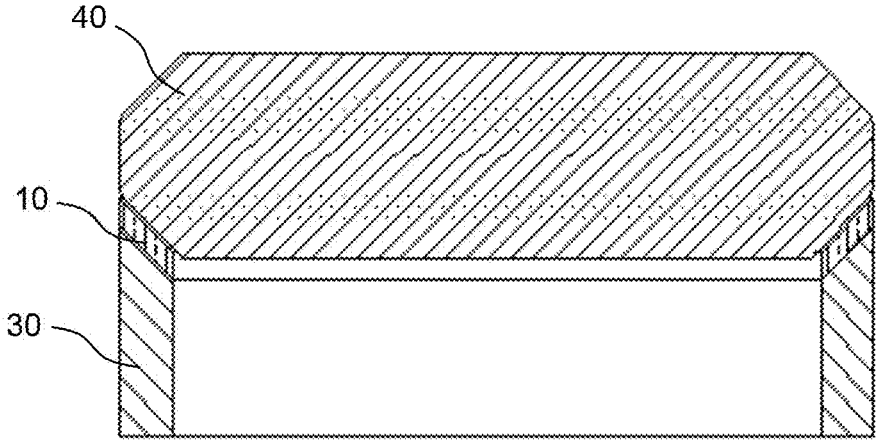
FIG. 17 displays a cross-sectional view of a frangible disk in a first position supported on a liner ring on a support structure base.
Figure 18:
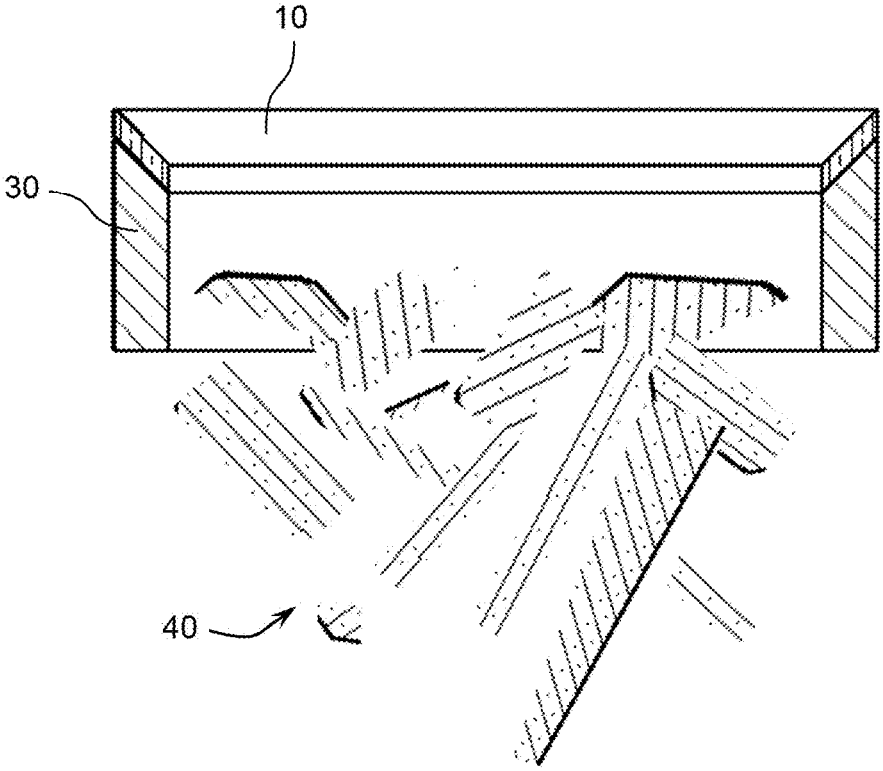
FIG. 18 displays a cross-sectional view of the frangible disk in a second position when broken, and passing the liner ring and support structure base shown in FIG. 17.
Figure 19:
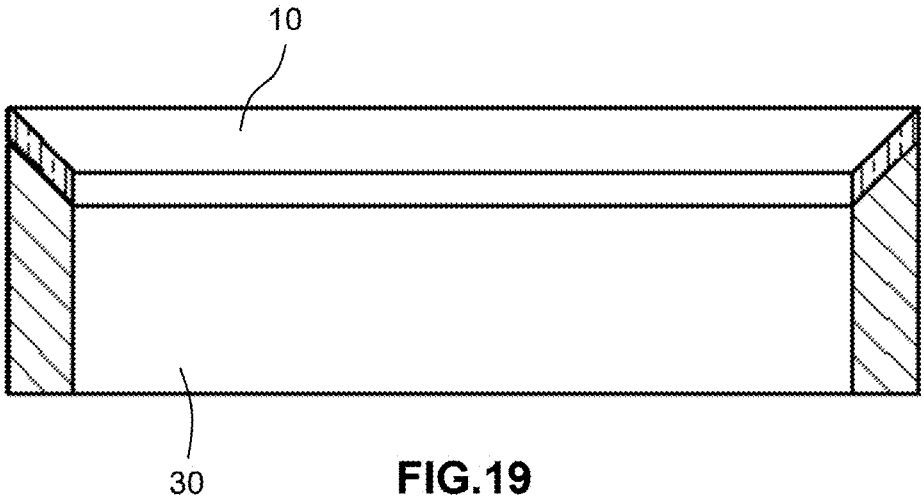
FIG. 19 displays a cross-sectional view of the liner ring on the support structure base shown in FIG. 17, after the broken frangible disk has passed.

Reference is now made to FIG. 17, which displays a cross-sectional view of the frangible disk 40 in a first position supported on a liner ring 10 on a support structure base 30. FIG. 18 displays a cross-sectional view of the frangible disk 40 in a second position when the disk is broken into bits 40*a* passing the liner ring 10 and support structure base 30 shown in FIG. 17. FIG. 19 displays a cross-sectional view of the liner ring 10 on the support structure base 30 shown in FIG. 17, after the broken frangible disk 40 has passed.

Figure 16:
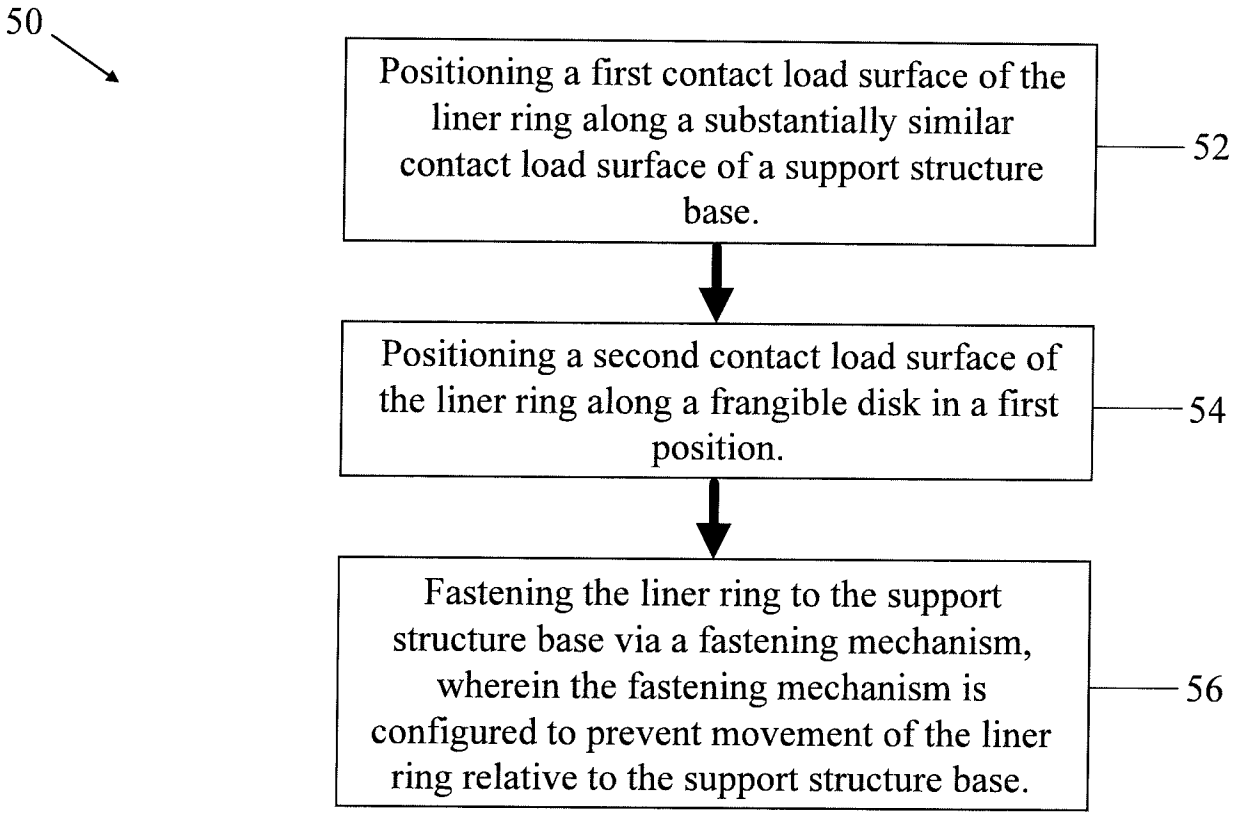
FIG. 16 is a flowchart for a method for fastening a liner ring to a support structure apparatus in a downhole tubular string, according to an illustrative embodiment.

Reference is now made to FIG. 16, which is a flowchart 50 for a method for fastening a liner ring 10 to a support structure apparatus in a downhole tubular string having a tubular axis, according to an illustrative embodiment. For discussion purposes, the fastening method is described with reference to the elements of FIGS. 1-16. The method is advantageous in that the liner ring 10 is prevented from separating from the support structure base 30, leading to the reduction/elimination of associated operational risks. At block 52, a first contact load surface 12*b* of the liner ring 10 is positioned along a substantially similar contact load surface of a support structure base 30. At block 54, a second contact load surface 12*a* of the liner ring 10 is positioned along a frangible disk 40 in a first position. At block 56, the liner ring 10 is fastened to the support structure base 30 via a fastening mechanism 14, where the fastening mechanism 14 is configured to prevent movement of the liner ring 10 relative to the support structure base 30.

In an embodiment, the fastening method further includes forming at least one of the first contact load surface 12*b* and the second contact load surface 12*a* with a defined contact geometry, where the defined contact geometry is at least one of: positioned along a plane perpendicular to the tubular axis, is frustoconical and shares an axis with a tubular of the tubular string, is frustoconically concave, or is frustoconically convex.

In a further embodiment, the fastening method further includes forming a first portion of the first contact load surface 12*b* and a second portion of the first contact load surface 12*b*, where the second portion of the first contact load surface 12*b* is parallel to the tubular axis.

In a further embodiment, the liner ring 10 is separated from the frangible disk 40 in a second position where the frangible disk 40 is broken.

In a further embodiment, the first contact load surface 12*b* and the substantially similar contact load surface of the support structure base 30 remain in contact when the frangible disk 40 is in the second position.

In a further embodiment, the fastening mechanism 14 prevents movement of the liner ring 10 relative to the support structure apparatus 1*a*-1*i* when the frangible disk 40 is in either of the first position or the second position.

In a further embodiment, the positioning of the fastening mechanism 14 further includes at least one of: welding the liner ring 10 to the support structure apparatus 1*a*-1*i*, threading the liner ring 10 to the support structure apparatus 1*a*-1*i*, screwing the liner ring to the support structure apparatus 1*a*-1*i*, riveting the liner ring 10 to the support structure apparatus 1*a*-1*i*, or interference fitting the liner ring 10 to at least the support structure apparatus 1*a*-1*i*.

In a further embodiment, the fastening method further includes providing a mating geometry between the liner ring 10, the support structure base 30, and at least a third part 20. In an additional embodiment, the at least third part 20 is at least one of: rigidly fixed relative to the support structure apparatus or pliantly fixed relative to the support structure apparatus.

In a further embodiment, the fastening method further includes forming a liner ring 10 circumference that is at least one of: fully segmented or partially segmented.

In embodiments, fastening mechanism 14 is at least one of: an adhesive, snap rings, a weld, threading, screws, rivets, or an interference fit between the liner ring 10 and at least the support structure base 30.

For the purposes of this disclosure, the term "substantially similar" may refer to a contact surface of either a support structure base 30 or a frangible disk 40 that at least overlaps all portions of a first or second contact load surface 12*b*, 12*a* of liner ring 10.

Unless otherwise defined, all technical and scientific terms used herein have the same meanings as are commonly understood by one of ordinary skill in the art to which this disclosure belongs. Although methods similar or equivalent to those described herein can be used in the practice or testing of the present disclosure, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present disclosure is not limited to what has been particularly shown and described hereinabove. Rather, the scope of the present disclosure is defined by the appended claims and includes both combinations and sub-combinations of the various features described hereinabove as well as variations and modifications thereof, which would occur to persons skilled in the art upon reading the foregoing description.

We claim:

1. A support structure apparatus for supporting a frangible disk in a downhole tubular string having a tubular axis, comprising:

a support structure base;

a liner ring having a first contact load surface in contact with a substantially similar contact load surface of the support structure base; and wherein the liner ring includes a second contact load surface in contact with the frangible disk in a first position, positioned on top of the second contact load surface when utilized in the downhole tubular string, and wherein the liner ring is separated from the frangible disk in a second position where the frangible disk is broken, a fastening mechanism positioned between the support structure base and the liner ring;

wherein the fastening mechanism is configured to prevent movement of the liner ring relative to the support structure base.

2. The apparatus of claim 1, wherein the liner ring includes a first portion and a second portion defining the first contact load surface, wherein the second portion of the liner ring is parallel to the tubular axis.

3. The apparatus of claim 1, wherein the fastening mechanism is at least one of: an adhesive, snap rings, a weld, threading, screws, rivets, or an interference fit between the liner ring and at least the support structure base.

4. The apparatus of claim 1, wherein the fastening mechanism is a mating geometry between the liner ring, the support structure base, and a wall surrounding the liner ring and the support structure base.

5. The apparatus of claim 4, wherein the wall is at least one of: rigidly fixed relative to the support structure apparatus or pliantly fixed relative to the support structure apparatus.

6. The apparatus of claim 1, wherein the liner ring includes a circumference that is at least one of: fully segmented or partially segmented.

7. The apparatus of claim 1, wherein the support structure base comprises at least one structural feature for mating with the liner ring.

8. The apparatus of claim 7, wherein each of the at least one structural feature is a groove, a thread, a hole, or a slot.

9. A method for fastening a liner ring to a support structure apparatus in a downhole tubular string having a tubular axis, the method comprising:

positioning a first contact load surface of the liner ring along a substantially similar contact load surface of a support structure base;

positioning a second contact load surface of the liner ring along a frangible disk in a first position; wherein the liner ring is separated from the frangible disk in a second position where the frangible disk is broken, and fastening the liner ring to the support structure base via a fastening mechanism;

wherein the fastening mechanism is configured to prevent movement of the liner ring relative to the support structure base.

10. The method of claim 9, further comprising forming at least one of the first contact load surface and the second contact load surface with a defined contact geometry, wherein the defined contact geometry is at least one of: positioned along a plane perpendicular to the tubular axis, is frustoconical and shares an axis with a tubular of the tubular string, is frustoconically concave, or is frustoconically convex.

11. The method of claim 9, further comprising forming a first portion of the first contact load surface and a second portion of the first contact load surface, wherein the second portion of the first contact load surface is parallel to the tubular axis.

12. The method of claim 2, wherein the first contact load surface and the substantially similar contact load surface of the support structure base remain in contact when the frangible disk is in the second position.

13. The method of claim 9, wherein the fastening mechanism prevents movement of the liner ring relative to the support structure apparatus when the frangible disk is in either of the first position or the second position.

14. The method of claim 13, wherein the positioning of the fastening mechanism further includes at least one of: welding the liner ring to the support structure apparatus, threading the liner ring to the support structure apparatus, screwing the liner ring to the support structure apparatus, riveting the liner ring to the support structure apparatus, or interference fitting the liner ring to at least the support structure apparatus.

15. The method of claim 9, further comprising providing a mating geometry between the liner ring, the support structure base, and a wall surrounding the liner ring and the support structure base.

16. The method of claim 15, wherein the wall is at least one of: rigidly fixed relative to the support structure apparatus or pliantly fixed relative to the support structure apparatus.

17. The method of claim 9, further comprising forming a liner ring circumference that is at least one of: fully segmented or partially segmented.

* * * * *